US009513073B2

(12) United States Patent
Sharps et al.

(10) Patent No.: US 9,513,073 B2
(45) Date of Patent: Dec. 6, 2016

(54) HYBRID FIREARM RECEIVER

(71) Applicant: Sharps Bros, LLC, Eugene, OR (US)

(72) Inventors: John Sharps, Eugene, OR (US); Joe Sharps, Eugene, OR (US)

(73) Assignee: Sharps Bros, LLC, Eugene, OR (US)

( * ) Notice: Subject to any disclaimer, the term of this patent is extended or adjusted under 35 U.S.C. 154(b) by 0 days.

(21) Appl. No.: 14/973,196

(22) Filed: Dec. 17, 2015

(65) Prior Publication Data

US 2016/0178297 A1 Jun. 23, 2016

Related U.S. Application Data

(60) Provisional application No. 62/096,150, filed on Dec. 23, 2014.

(51) Int. Cl.
*F41A 11/02* (2006.01)
*F41A 3/66* (2006.01)

(52) U.S. Cl.
CPC ..... *F41A 3/66* (2013.01)

(58) Field of Classification Search
CPC ..... F41A 3/66; F41A 3/84; F41A 11/02; F41A 5/18; F41A 5/24
USPC ..... 42/16, 14; 89/191.01
See application file for complete search history.

(56) References Cited

U.S. PATENT DOCUMENTS

| | | | | |
|---|---|---|---|---|
| D689,974 | S * | 9/2013 | Sharps | D22/108 |
| 2009/0288324 | A1* | 11/2009 | Peterson | F41A 11/02 42/75.03 |
| 2012/0152104 | A1* | 6/2012 | Audibert | F41A 5/18 89/191.01 |
| 2012/0167433 | A1* | 7/2012 | Robbins | F41A 11/02 42/75.02 |
| 2012/0297656 | A1* | 11/2012 | Langevin | F41A 3/66 42/16 |
| 2014/0075804 | A1* | 3/2014 | Langevin | F41C 23/16 42/16 |
| 2015/0000171 | A1* | 1/2015 | Roberts | F41A 3/66 42/75.03 |
| 2016/0187084 | A1* | 6/2016 | Hochstrate | F41A 5/18 89/191.01 |

* cited by examiner

*Primary Examiner* — Michael David
(74) *Attorney, Agent, or Firm* — Lowe Graham Jones, PLLC

(57) ABSTRACT

A hybrid firearm receiver includes a receiver body having a first end, a second end opposite the first end, a substantially planar bottom surface extending from the first end to the second end and transitioning to two upwardly extending opposing sidewalls, and a top end, the receiver body extending along a longitudinal axis from the first end to the second end. The first end is integrally formed with the receiver body and includes a circular first cavity and a smaller circular second cavity below the circular first cavity. The second end includes an aperture. The axis extends through a center of the circular first cavity and through the aperture and is below the top end. The circular first cavity may be configured to receive a portion of an AR-15 rifle stock assembly. The aperture may be configured to receive an AK pattern rifle barrel.

13 Claims, 10 Drawing Sheets

HYBRID FIREARM RECEIVER

PRIORITY CLAIM

This application claims the benefit of prior U.S. provisional application No. 62/096,150, filed Dec. 23, 2014, the contents of which are incorporated by reference.

FIELD OF THE INVENTION

This application relates generally to firearms, particularly including firearm receivers.

BACKGROUND OF THE INVENTION

Firearms such as rifles are popular amongst hunters, gun enthusiasts, sharpshooters, military and police personnel, and the like. For example, AK pattern rifles, including the AK-47, AKM, AK-74, and AK-100 rifles are widely appreciated for their substantial reliability, relatively low production costs, and ease of use. However, many firearms, including AK pattern rifles, possess both favorable and unfavorable features.

For example, AK pattern rifles are renowned for consistent performance under a variety of environmental conditions. Additionally, the firing mechanism of an AK pattern rifle is readily accessible within the rifle receiver, making it easy to repair and replace component parts of the firing mechanism. Yet, many users find the typical stock design of an AK pattern rifle to be undesirable.

The typical AK-pattern stock is typically milled from a single piece of wood or plastic and assumes downward-sloping trapezoidal shape from the receiver toward the user. As a result, the stock is heavy, is not easily customized, and is therefore not ideal for users of varying builds and shooting styles. Moreover, the downward slope of the AK pattern stock results in a nonlinear recoil path; that is, recoil action from firing is not transmitted in a straight line from the barrel back to the user's shoulder or other body part. This can result in the user assuming a somewhat unnatural "hunched" position to absorb recoil and keep the barrel trained on a target when firing from the shoulder, and can complicate recoil management.

Other types of rifle stocks enjoy advantages over the AK pattern stock. For example, the stock of an AR-15 semiautomatic rifle is a lightweight, customizable, and ergonomically favorable stock that is amenable to use by users of varying builds and shooting styles. The AR-15 stock typically possesses a relatively low-profile, minimalist design, making the typical AR-15 stock lighter than the typical AK pattern stock. Additionally, the AR-15 stock attaches generally in line with the barrel, creating a straight recoil path from the barrel to the user's shoulder in the standard firing position. Moreover, the length of the AR-15 stock may be adjusted by pulling, thereby permitting a customized fit for a given user's body type and preferred shooting style. Thus, the stock may sit snugly against the lower receiver for use by a shooter with shorter arms or one who prefers tight control over the rifle, or may be extended away from the receiver for use by a shooter with longer arms or one who is otherwise more comfortable with a longer rifle configuration.

The differences between the typical AK pattern and AR-15 stocks are reflected in the connection mechanism between the stock and the receiver. For example, the AR-15 stock connects to the AR-15 lower receiver by means of a threaded, generally cylindrical buffer extension tube housed within a recess formed in the stock opposite the butt end. The buffer tube protrudes from the recess and mates with a round, threaded aperture formed in an upwardly projecting portion of the lower receiver. The upwardly projecting portion is disposed in line with the barrel, above the main body of the lower receiver and the firing assembly components housed therein.

The AK pattern stock, on the other hand, defines a roughly rectangular block opposite the butt end and a recess along a top surface of the stock. A first end of the receiver defines a downwardly-angled face with a rectangular opening for receiving the block. A protrusion located above the rectangular opening protrudes toward the stock at a slight downward angle. When the block is inserted into the rectangular opening, the recess receives the protrusion. The protrusion includes an aperture through which a screw or pin may be extended, with an extending portion of the screw or pin being received by the recess to secure the stock to the receiver. Some variations of the AK pattern stock and receiver include a second protrusion below the rectangular opening at the stock first end and a corresponding second recess along the bottom surface of the stock.

Other differences exist between the AR-15 and AK pattern receivers. For example, unlike the AR-15 lower receiver, the AK-47 receiver defines an aperture for receiving the rifle barrel opposite the stock connection. Moreover, the AK pattern receiver houses all of the internal mechanisms, including the firing bolt, bolt carrier, piston, carrier spring, hammer assembly, trigger guard rivets, firing pin assembly, and disconnector assembly, in a single, relatively accessible space. This design allows for straightforward removal and replacement of the various components. The internal mechanisms of the AR-15, on the other hand, are split between the lower receiver, which couples to the stock, and an upper receiver, which receives the barrel. The internal space of the AR-15 lower receiver is somewhat tighter and more difficult to easily navigate than that of the AK pattern receiver.

Some attempts have been made to combine the favorable characteristics of various rifle types, including the AR-15 and AK pattern rifles, to create a firearm that enjoys multiple advantages over its various substituent firearms. For example, adapters have been created that interface with a receiver from a first firearm type and a stock from a second firearm type at an opposing surface. One example is an adapter configured to mate an AK pattern receiver with an AR-15 stock.

However, this approach suffers numerous shortcomings. For example, many such adapters are configured to mate with the downwardly-angled first end of the AK pattern receiver and to receive the protrusion. The attendant downward angle of the adapter results in the AR-15 stock, designed for alignment with the barrel and a straight-line recoil path, sitting unnaturally low relative to the barrel and recoil path. Moreover, the adapter creates an additional separation distance, equal to at least the length of the AK pattern receiver protrusion, between the main body of the receiver and the stock. Due to this additional minimum distance, the user's ability to customize the operational length of the firearm is compromised, and the ergonomic profile of the resulting firearm may be undesirable for certain users.

Further, adapters are relatively small, easily lost, may break or warp, and can be costly to replace. Importantly, the introduction of an adapter between the receiver and the stock may create inconsistencies if the fit between the three pieces is less than perfect, or if the adapter wears over time and use.

Such inconsistencies can affect the accuracy, recoil action, and integrity of the firearm, leading to unreliable and dangerous performance.

SUMMARY OF THE INVENTION

In a preferred example of the invention, a hybrid firearm receiver includes a receiver body having a first end, a second end opposite the first end, a bottom surface extending from the first end to the second end and transitioning to two upwardly extending opposing sidewalls, and a top end, the receiver body extending along a longitudinal axis from the first end to the second end.

The first end is integrally formed with the receiver body and defines a first outer face comprising a rounded upper portion having a first maximum width and a rounded lower portion having a second maximum width, the first maximum width being greater than the second maximum width. The upper portion includes a circular first cavity extending inwardly along the axis toward the second end. The circular first cavity has threaded interior sidewalls, a first diameter, and a center, the axis extending through the center. The lower portion includes a circular second cavity extending inwardly along a direction parallel to the axis toward the second end. The circular second cavity has a second diameter that is smaller than the first diameter. In preferred examples of the invention, the first diameter is 1.392 inches and the second diameter is from 0.495 inches to 0.54 inches. In other examples of the invention, the first diameter may be from 1 inch to 1.6 inches, and the second diameter may be from 0.4 inches to 0.6 inches.

In some examples of the invention, the first end has a rounded top surface having a top length extending parallel to the axis. In some examples, the top length is from 0.5 inches to 1 inch. In some examples, the top length is from 0.6 inches to 0.8 inches. In some examples, the top length is from 0.62 inches to 0.64 inches. In preferred examples, the top length is from 0.628 inches to 0.638 inches.

The second end defines a second outer face with an aperture, the axis extending through the aperture. In preferred examples of the invention, the aperture is from 0.905 inches to 1 inch in diameter. In a preferred example of the invention, the second end includes a third cavity below the aperture and above the bottom surface, the third cavity defining a rounded rectangle. The second end further includes a top surface with two opposing upwardly extending projections and a channel therebetween, the channel bounded by the projections and open in both directions parallel to the axis.

The bottom surface has a bottom width at the first end that narrows as it approaches the first outer face. The two opposing sidewalls project upwardly from the bottom surface along the length of the receiver body between the first end and the second end and terminate at the top end to form a rim along the length of the receiver body between the first end and the second end. A segment of one of the opposing sidewalls abuts the second end and extends upwardly above a corresponding segment of the other opposing sidewall.

The center of the circular first cavity is lower than the top end. The top end joins the two opposing sidewalls in a region adjacent the first end, axially opposite the first outer face upper portion and toward the second end. The top end, the first end, and the opposing sidewalls form a trough extending transverse to the axis.

In a preferred example of the invention, the axis is perpendicular to the first outer face and the bottom surface is substantially planar, as described herein, as it extends between the first end and the second end. In other examples, the bottom surface may be irregular, or not substantially planar, as described herein. The bottom surface extends substantially along a plane that is transverse to the axis by 2.5 degrees, meaning that the bottom surface extends along an incline of 2.5 degrees between the first end and the second end.

In some examples of the invention, the receiver body has a length from 9 inches to 12 inches from the first end to the second end along the axis. In some examples of the invention, the length is from 10 inches to 11 inches. In some examples of the invention, the length is from 10.5 inches to 10.9 inches. In a preferred example of the invention, the length is 10.7 inches.

In a preferred example of the invention, the circular first cavity is configured to receive at least a counterthreaded portion of an AR-15 buffer extension tube and the aperture is configured to receive at least a portion of an AK pattern rifle barrel, such as, for example, an AK-47 rifle barrel, an AK-74 rifle barrel, an AKM rifle barrel, or an AK-100 rifle barrel. In another example of the invention, a firearm includes a hybrid firearm receiver according to the invention, an AR-15 rifle stock, and an AK pattern rifle barrel.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1A:
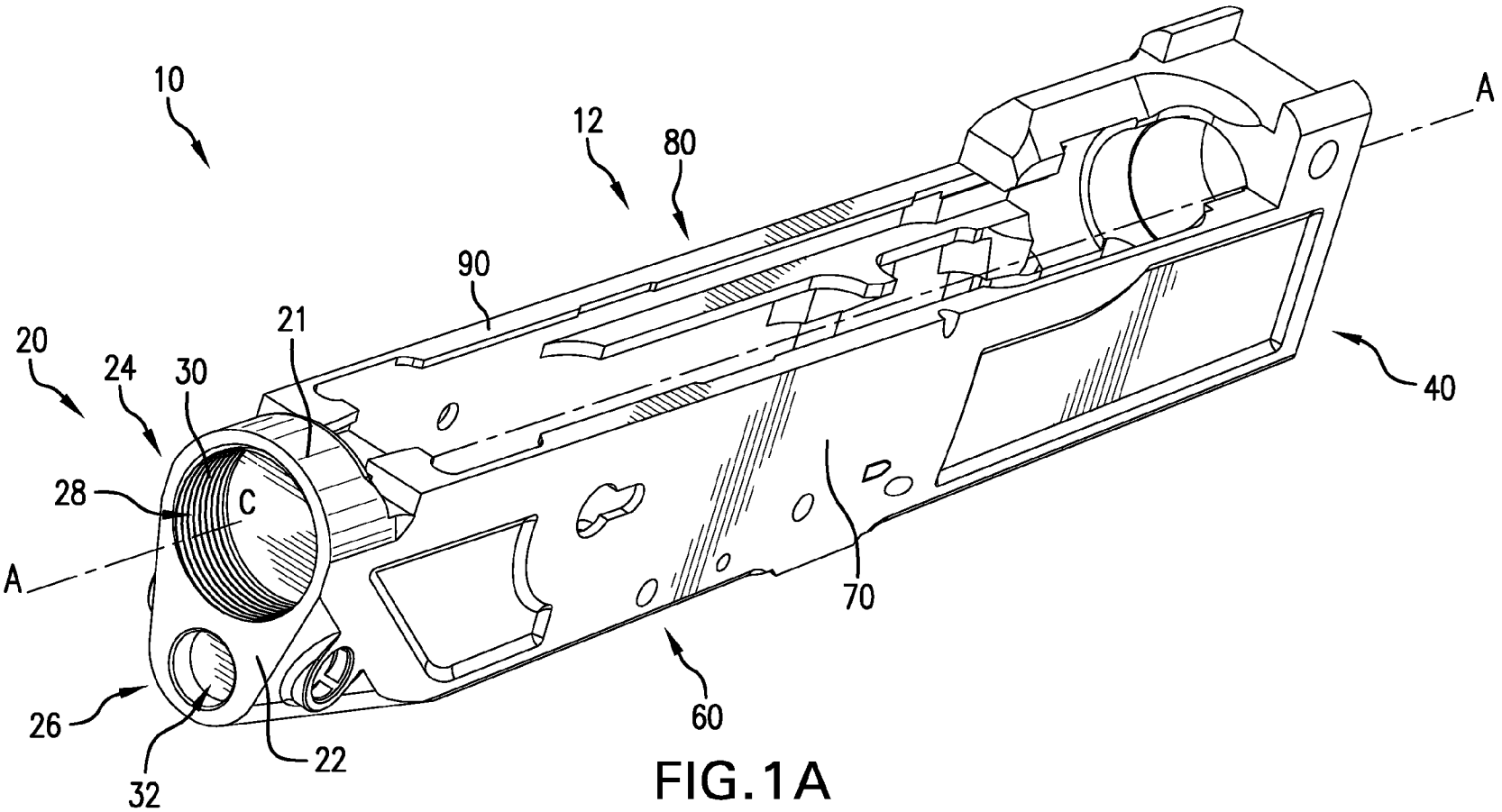
FIG. 1A is a top perspective view of a preferred example of a hybrid firearm receiver elongated along an axis A.
Figure 1B:
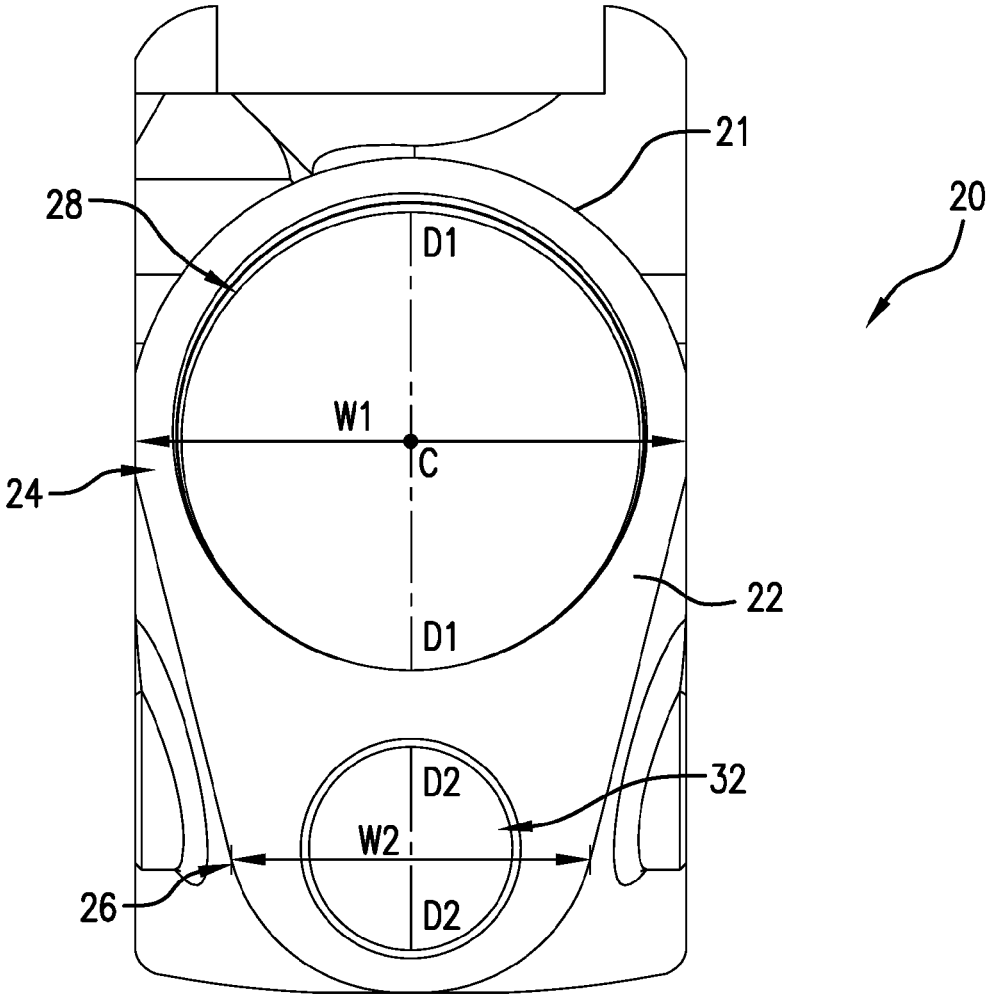
FIG. 1B is a front elevational view of a first end of the firearm receiver of FIG. 1A.
Figure 1C:
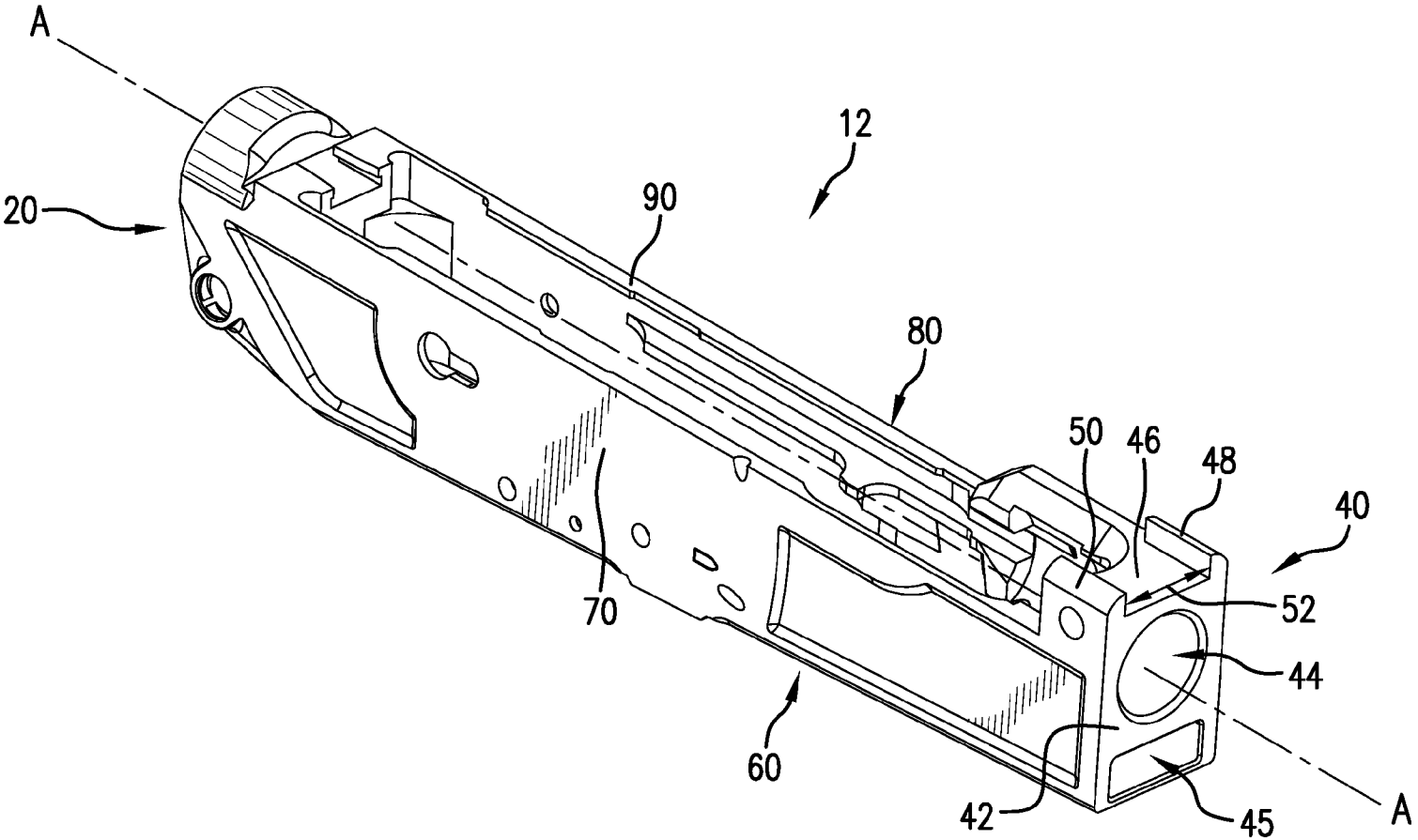
FIG. 1C is a second top perspective view of the hybrid firearm receiver of FIG. 1A.
Figure 1D:
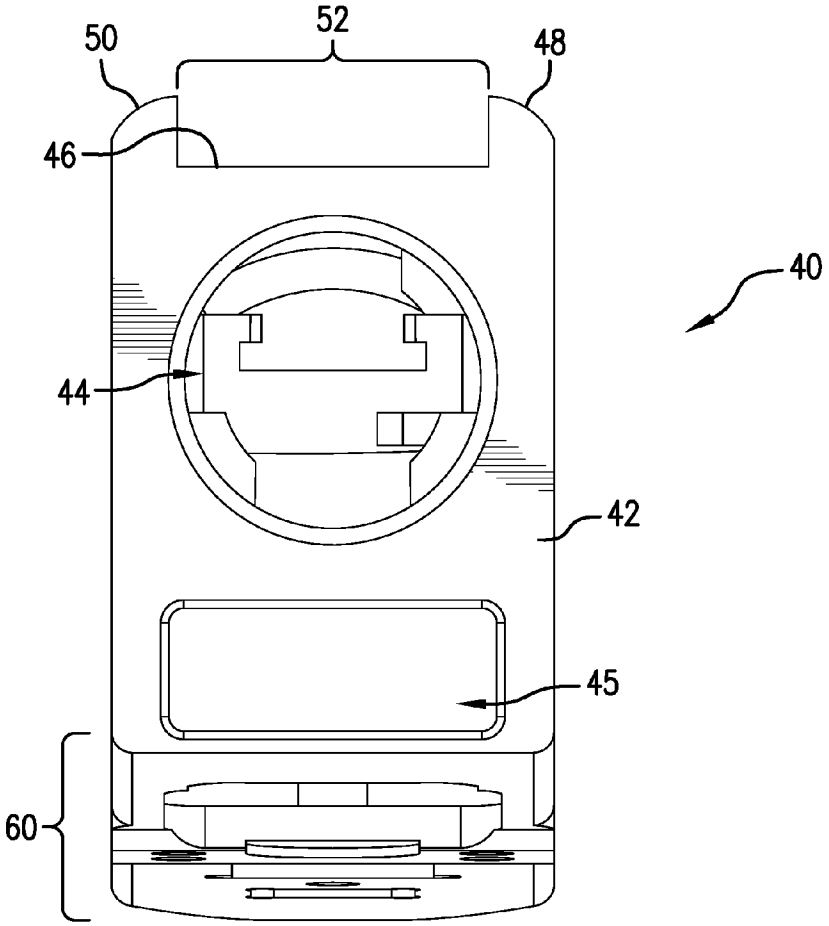
FIG. 1D is a front elevational view of a second end, opposite the first end, of the hybrid firearm receiver of FIG. 1A.
Figure 1E:
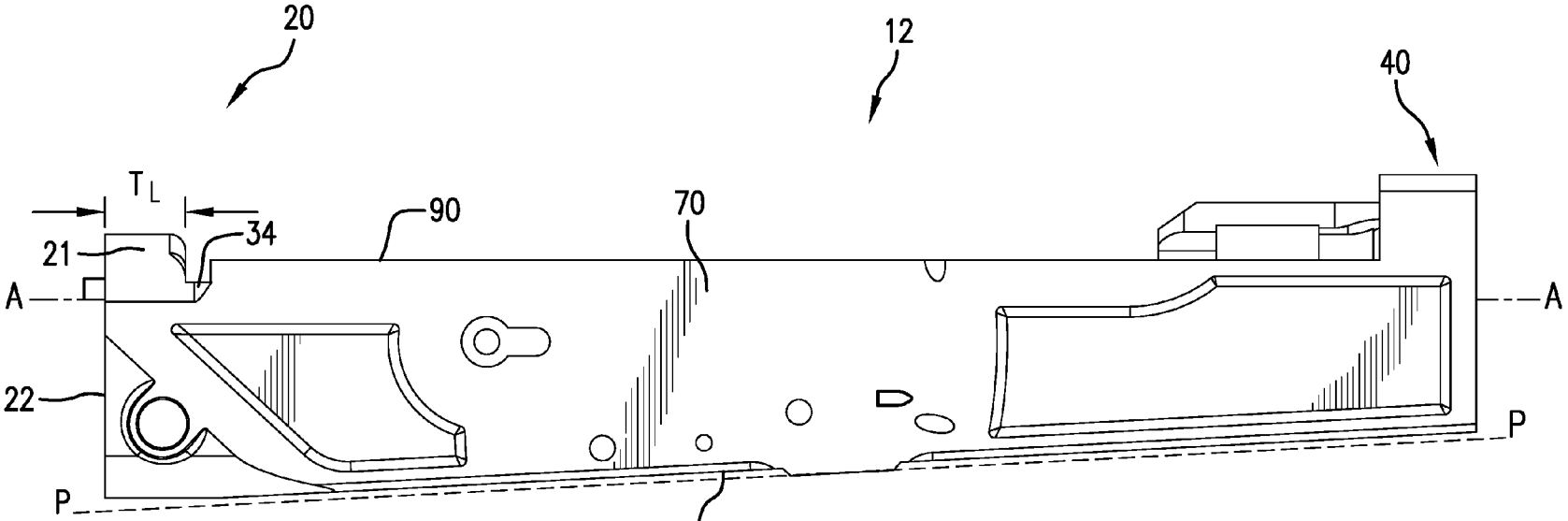
FIG. 1E is right side elevational view of the hybrid firearm receiver of FIG. 1A, the receiver elongated along the axis A and the bottom surface inclined substantially along a plane P.
Figure 1F:
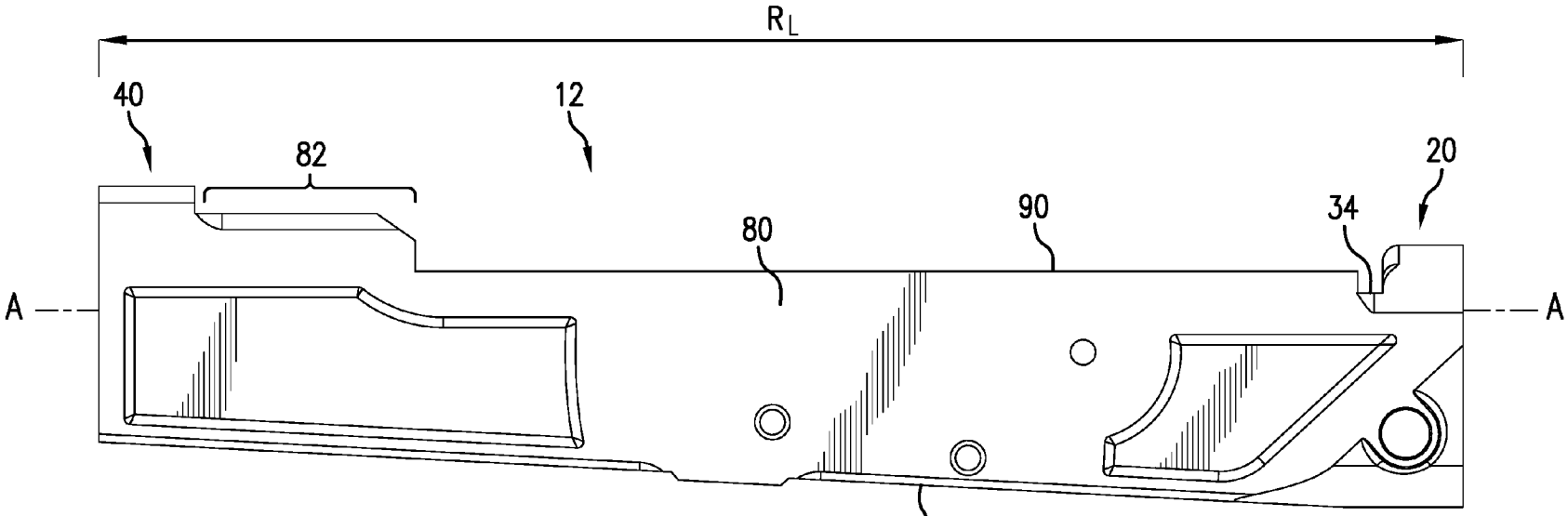
FIG. 1F is a left side elevational view of the hybrid firearm receiver of FIG. 1A.
Figure 1G:
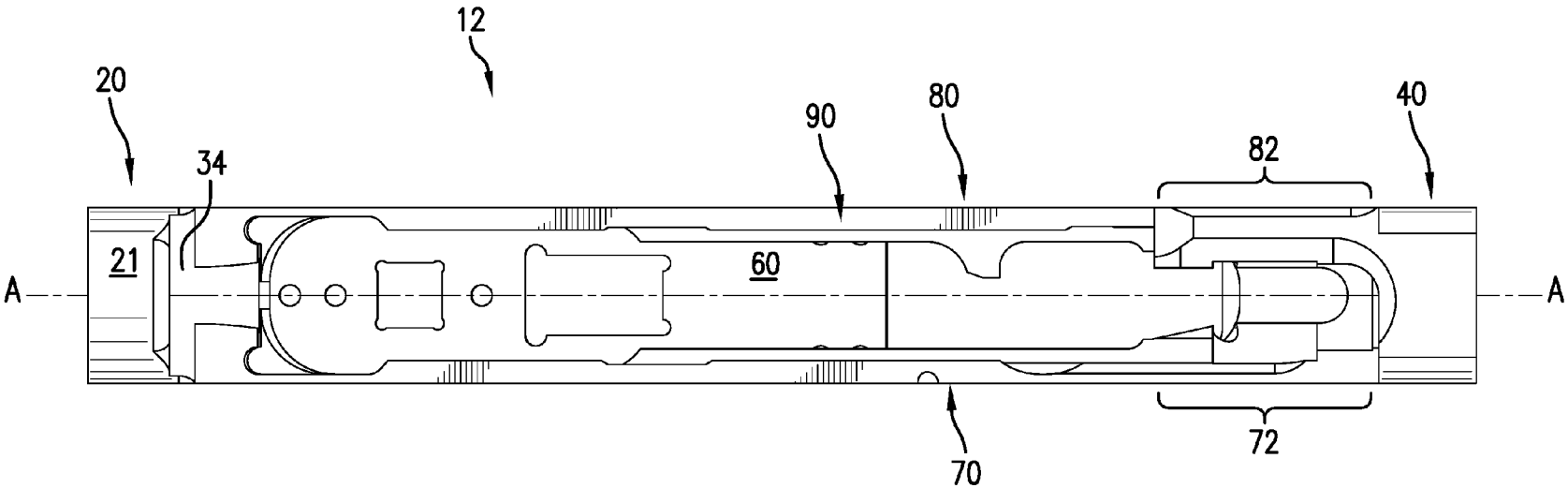
FIG. 1G is a top plan view of the hybrid firearm receiver of FIG. 1A.
Figure 1H:
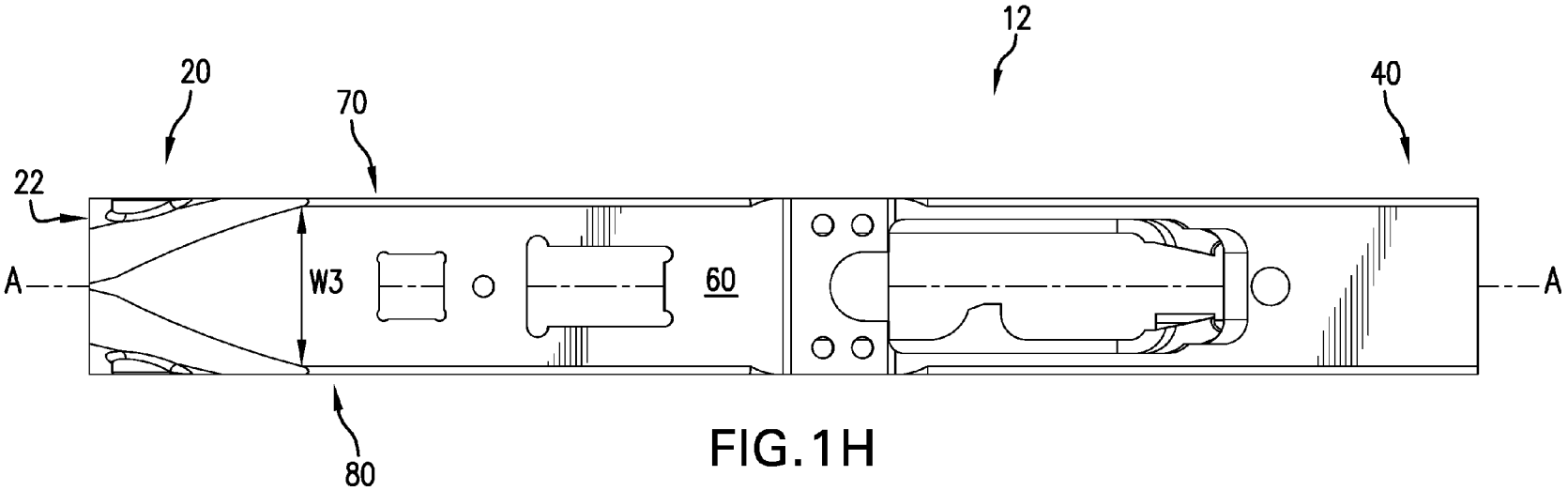
FIG. 1H is a bottom plan view of the hybrid firearm receiver of FIG. 1A.
Figure 2A:
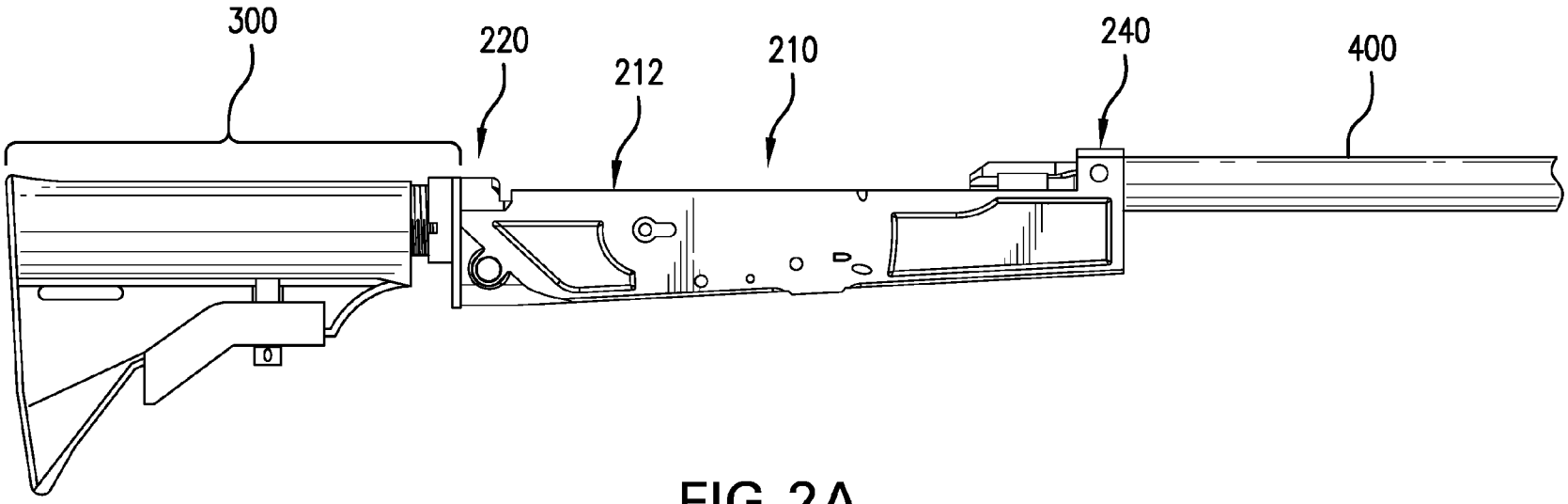
FIG. 2A is a right side elevational view of a hybrid firearm receiver according to the invention, coupled to an AR-15 rifle stock assembly and receiving an AK pattern rifle barrel.
Figure 2B:
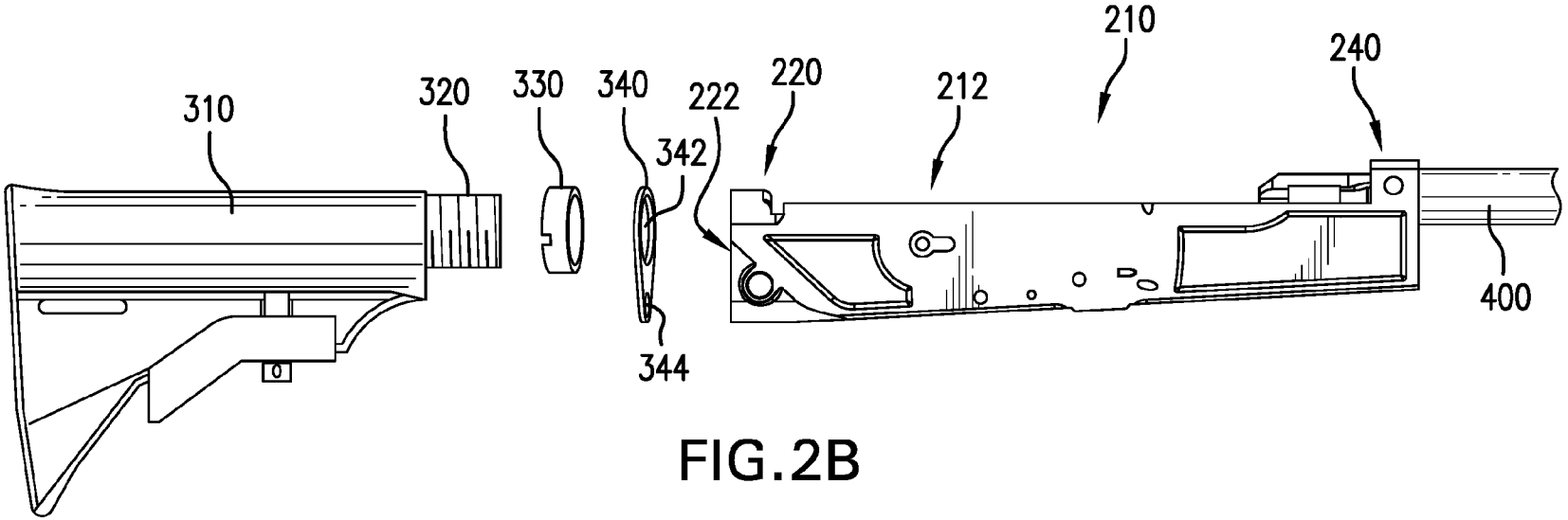
FIG. 2B is a right side elevational view of the hybrid firearm receiver of FIG. 2A decoupled from the AR-15 rifle stock assembly and with the components of the AR-15 rifle stock assembly exploded.

A hybrid firearm receiver is illustrated alone in FIGS. 1A-1H and in combination with other firearm components in FIGS. 2A-2B.

As best seen in FIG. 1A, the hybrid firearm receiver 10 includes a receiver body 12 having a first end 20, a second end 40 opposite the first end 20, and a bottom surface 60 extending from the first end 20 to the second end 40 and transitioning to two upwardly extending opposing sidewalls 70, 80. The two opposing sidewalls 70, 80 terminate at a top end 90 to form a rim along the length of the receiver body 12 from the first end 20 to the second end 40. The receiver body 12 extends along a longitudinal axis A from the first end 20 to the second end 40.

The first end 20 is integrally formed with the receiver body 12 and includes a rounded top surface 21 having a top length TL (see FIG. 1E) extending parallel to the axis A and which in the preferred embodiment is between 0.628 inches and 0.638 inches. As best seen in FIG. 1B, the first end 20 defines a first outer face 22 having a rounded upper portion 24 with a first maximum width W1 and a rounded lower portion 26 with a second maximum width W2, the first maximum width W1 being greater than the second maximum width W2.

The upper portion 24 includes a relatively shallow circular first cavity 28 extending inwardly along the axis A toward the second end 40. The circular first cavity 28 has threaded interior sidewalls 30, a first diameter D1, and a center C, with the axis A extending through the center C and perpendicular to the first outer face 22. In the preferred embodiment, the first diameter D1 measures 1.392 inches, and the center C and the axis A are below the top end 90. The circular first cavity 28 extends inwardly from 0.3 inches to 0.6 inches along the axis A, and in the preferred embodiment extends inwardly 0.555 inches along the axis A.

The lower portion 26 includes a circular second cavity 32 extending inwardly in a direction parallel to the axis A and toward the second end 40. The second circular cavity 32 extends inwardly from 0.1 to 0.35 inches, and in the preferred embodiment extends inwardly 0.20 inches. The circular second cavity 32 has a second diameter D2 that is smaller than the first diameter D1. As best seen in FIGS. 1E and 1G, the top end 90, the sidewalls 70, 80 (80 not shown in FIG. 1E), and the first end 20 form a trough 34 adjacent the first end 20 and extending transverse to the axis A. The top end 90 extends parallel to the axis A along the length of the receiver body 12 between the first 20 and second 40 ends.

Turning to FIGS. 1C and 1D, the second end 40 defines a second outer face 42 with an aperture 44, the axis A extending through the aperture 44. The second outer face 42 has a width, transverse to the axis A, of 1.35 inches. The second end 40 includes a top surface 46 with two opposing upwardly extending projections 48, 50 and a channel 52 therebetween, the channel 52 bounded by the projections 48, 50 and open in both directions parallel to the axis A. The second outer face 42 further defines a third cavity 45 in the shape of a rounded rectangle below the aperture 44 and above the bottom surface 60. The bottom surface 60 transitions upwardly along a curve transverse to the axis A to form the two opposing sidewalls 70, 80. Alternatively, the transition may be sharp, forming an angle between the bottom surface 60 and each of the two opposing sidewalls 70, 80. Each of the two opposing sidewalls 70, 80 extends upwardly and, in at least the preferred embodiment, perpendicular to the bottom surface 60.

As seen in FIG. 1E, the bottom surface 60 is substantially planar and extends transverse to the axis A along the length of the receiver body 12 between the first 20 and second 40 ends. By "substantially planar", it is meant that a plane P extends along the bottom surface 60 from the first end 20 to the second end 40 and that no portion of the bottom surface 60 extends below the plane P by a distance greater than ten percent of the height of an adjoining sidewall 70, 80 when a portion of the bottom surface 60 is in contact with the plane P. For example, if the sidewall 70 has a height of 1.5 inches at a given point and a portion of the bottom surface 60 is in contact with the plane P, the bottom surface at that point extends no more than 0.15 inches below the plane P. In the preferred embodiment, the bottom surface 60 extends no more than 0.06 inches below the plane P. In the preferred embodiment, the plane P is transverse to the axis A along a 2.5 degree incline. However, in other embodiments, the plane P may be transverse to the axis A along an incline of from 1 degree to 3.5 degrees.

As seen in FIG. 1F, the receiver body 12 has a length RL, which in the preferred embodiment may be 10.7 inches from the first end 20 to the second end 40 along the axis A. A segment 82 of one 80 of the opposing sidewalls abuts the second end 40 and extends upwardly above a corresponding segment 72 of the other opposing sidewall 70 (see FIG. 1G). To form the rounded upper 24 and lower 26 portions of the first outer face 22, the bottom surface 60 and a portion of each of the sidewalls 70, 80 change conformation along the first end 20. For example, the bottom surface 60 has a bottom width W3 along the first end 20 that narrows as it approaches the first outer face 22 (See FIG. 1H). Additionally, the transition from the bottom surface 60 to the sidewalls 70, 80 becomes more gradual approaching the first outer face 22. A lower portion of each of the sidewalls 70, 80 transitions from following a direction parallel to the axis A to following a direction transverse to the axis A.

Turning to FIGS. 2A and 2B, a hybrid firearm receiver 210 according to the invention includes a receiver body 212 having a first end 220 and a second end 240. The first end 220 may couple with an AR-15 rifle stock assembly 300 and the second end 240 may receive an AK pattern rifle barrel 400. In FIG. 2A, the firearm receiver 210, AR-15 rifle stock assembly 300, and AK pattern rifle barrel 400 are shown assembled together, while in FIG. 2B, the AR-15 rifle stock assembly 300 is decoupled from the firearm receiver 210 and exploded to reveal its component parts 310, 320, 330, 340, 342, 344.

The stock 310 includes a stock recess (not shown) that receives a portion of the buffer extension tube 320. A portion of the buffer extension tube 320 extends outwardly from the stock 310 and is counterthreaded to mate with the threaded sidewall 30 of the circular first cavity (see, for example, element 28 of FIG. 1A). A lock ring 330 fits over the buffer extension tube 320 and secures the buffer extension tube 320 in place. Closest to the first end 220 of the receiver body 212 is a receiver end piece 340 including an aperture 342 and a rounded protrusion 344 extending toward the first end 220. The receiver end piece 340 sits flush with the first outer face 222, with the aperture 340 corresponding to the circular first cavity (see, for example, element 30 of FIG. 1A) and the rounded protrusion 344 being received by the circular second cavity (see, for example, element 32 of FIG. 1A).

The hybrid firearm receiver 10, 210 permits use of an AR-15 rifle stock and AK pattern rifle barrel in a single firearm. The AR-15 stock, among other advantages, decreases weight, improves recoil management, and enables greater customization of the firearm relative to an AK pattern rifle. The receiver 10, 210 additionally provides easy access to the internal mechanisms, such as the firing mechanism, of the firearm. The receiver 10, 210 is integrally formed, resulting in a single-piece construction that limits the potential for troublesome and dangerous inconsistencies associated with adapters. While component materials such as steel may be used to form the receiver 10, 210, single-piece construction using, for example, a CNC machine may permit use of alternative materials, including, for example, billet 6061 or 7075 aluminum.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A firearm receiver, comprising:

a receiver body having a first end, a second end opposite the first end, a bottom surface extending from the first end to the second end and transitioning to two upwardly extending opposing sidewalls, and a top end, the receiver body extending along a longitudinal axis from the first end to the second end, the first end being integrally formed with the receiver body and defining a first outer face comprising a rounded upper portion having a first maximum width and a rounded lower portion having a second maximum width, the first maximum width being greater than the second maximum width, the upper portion comprising a circular first cavity extending inwardly along the axis toward the second end, the circular first cavity having threaded interior sidewalls, a first diameter, and a center, the axis extending through the center, and the lower portion comprising a circular second cavity extending inwardly toward the second end along a direction parallel to the axis and having a second diameter that is smaller than the first diameter, the second end defining a second outer face comprising an aperture, the axis extending through the aperture, the second end comprising a top surface including two opposing upwardly extending projections and a channel therebetween, the channel bounded by the projections and open in both directions parallel to the axis, the bottom surface having a bottom width at the first end that narrows as it approaches the first outer face, and the two opposing sidewalls projecting upwardly from the bottom surface along the length of the receiver body between the first end and the second end and terminating at the top end to form a rim along the length of the receiver body between the first end and the second end, a segment of a one of the opposing sidewalls abutting the second end extending upwardly above a corresponding segment of the other opposing sidewall, wherein the center of the circular first cavity is lower than the top end and wherein the top end joins the two opposing sidewalls adjacent the first end axially opposite the first outer face upper portion and toward the second end, the top end, the two opposing sidewalls, and the first end forming a trough extending transverse to the axis.

2. The firearm receiver of claim 1, wherein the axis is perpendicular to the first outer face.

3. The firearm receiver of claim 1, wherein the bottom surface is substantially planar as it extends from the first end to the second end.

4. The firearm receiver of claim 1, wherein the second end defines a third cavity below the aperture and above the bottom surface, the third cavity defining a rounded rectangle.

5. The firearm receiver of claim 4, wherein the circular first cavity is configured to receive at least a counterthreaded portion of an AR-15 buffer extension tube and the aperture is configured to receive at least a portion of an AK pattern rifle barrel.

6. A firearm, comprising:

the firearm receiver of claim 5;

an AR-15 rifle stock; and an AK pattern rifle barrel.

7. The firearm receiver of claim 1, wherein the first end has a rounded top surface having a top length parallel to the axis, the top length being from 0.5 inches to 1 inch.

8. The firearm receiver of claim 7, wherein the top length is from 0.6 inches to 0.8 inches.

9. The firearm receiver of claim 7, wherein the top length is from 0.628 inches to 0.638 inches.

10. The firearm receiver of claim 1, wherein the receiver body is from 9 inches to 12 inches from the first end to the second end along the axis.

11. The firearm receiver of claim 10, wherein the receiver body is from 10 inches to 11 inches from the first outer face to the second outer face along the axis.

12. The firearm receiver of claim 10, wherein the receiver body is from 10.5 inches to 10.9 inches from the first outer face to the second outer face along the axis.

13. The firearm receiver of claim 10, wherein the receiver body is 10.7 inches from the first outer face to the second outer face along the axis.

* * * * *